United States Patent [19]

Ruhl et al.

[11] 3,968,938

[45] July 13, 1976

[54] SYSTEM FOR HANDLING DEBRIS

[75] Inventors: Walter Franklin Ruhl; Albert W. Nelson; Jesse J. Lucy, all of Greenville, Ohio; Gerald N. Marshall, Union City, Ind.

[73] Assignee: Lambert Corporation, Dayton, Ohio

[22] Filed: Sept. 10, 1974

[21] Appl. No.: 504,484

[52] U.S. Cl. ..... 241/101.1; 15/330; 15/337; 15/339; 15/405; 241/101.7; 241/189 R

[51] Int. Cl.[2] ..... B02C 18/06

[58] Field of Search ..... 15/328, 330, 331, 337, 15/405, 339; 241/101.7, 101.1, 101.2, 190, 189 R

[56] References Cited

UNITED STATES PATENTS

| | | | |
|---|---|---|---|
| 2,590,734 | 3/1952 | Strong | 15/339 X |
| 3,147,510 | 9/1964 | Thompson | 15/337 |
| 3,412,770 | 11/1968 | Johnson | 241/190 X |
| 3,491,399 | 1/1970 | Dolan et al. | 15/328 X |
| 3,618,157 | 11/1971 | Bassin | 15/331 X |
| 3,688,479 | 9/1972 | Martinson et al. | 241/101.7 X |
| 3,813,725 | 6/1974 | Rinker | 15/337 X |

*Primary Examiner*—Leonard D. Christian
*Assistant Examiner*—C. K. Moore
*Attorney, Agent, or Firm*—Richard G. Wynne

[57] ABSTRACT

A system is provided for handling debris, such as twigs, leaves, grass cuttings, refuse and the like comprising a fan-shredding device including a vacuum nozzle, the nozzle being shut off from the fan suction when various units are mounted thereon, such as a hopper and a flexible extension hose. Also, a blower is provided by similarly mounting a cowl on the nozzle and a blower tube on the discharge chute of the fan-shredding device. Shredded debris is bagged in a bag mounted on the discharge chute. On bagging, the shredded debris is compacted by the fan blowing action on the small shredded particles.

5 Claims, 7 Drawing Figures

FIG. 5
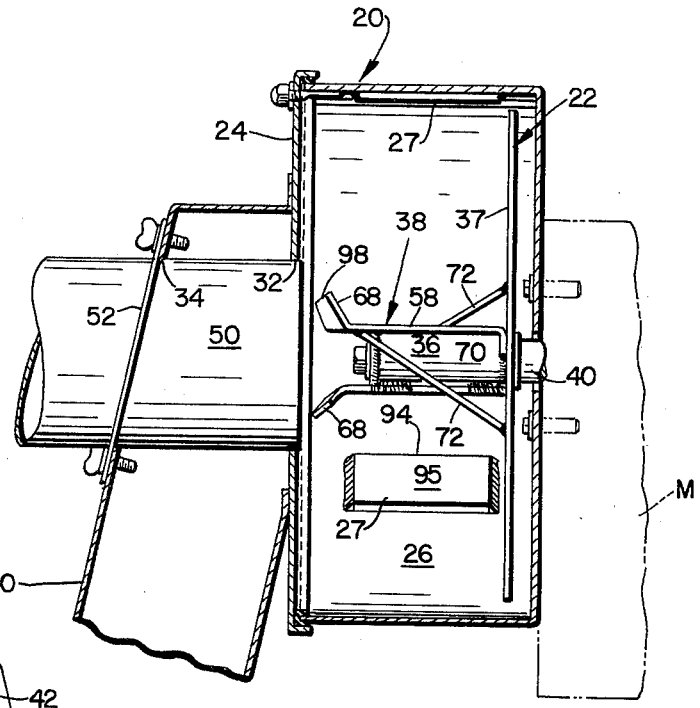
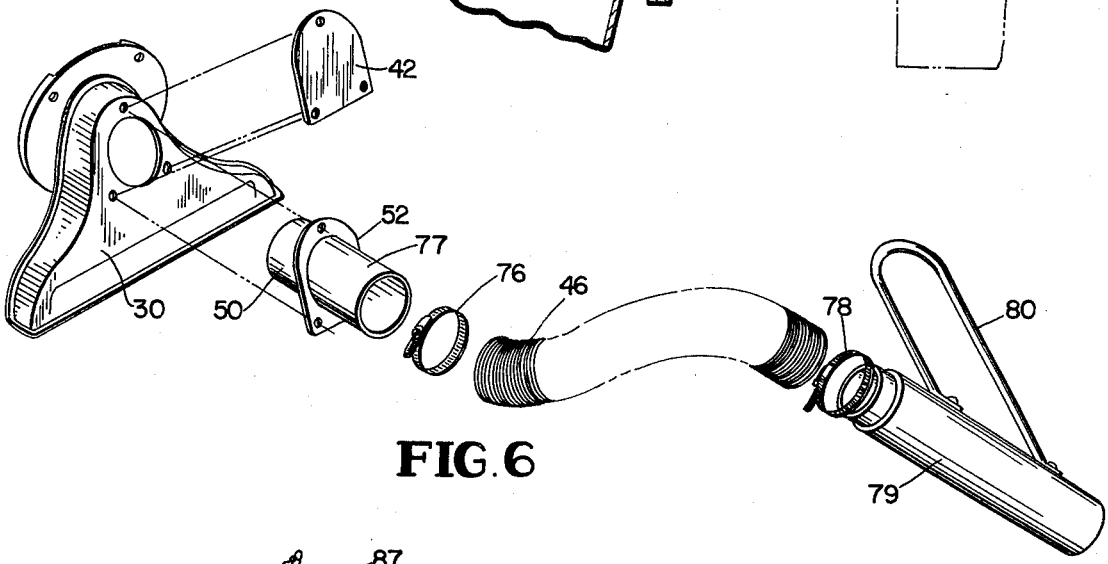
FIG. 6
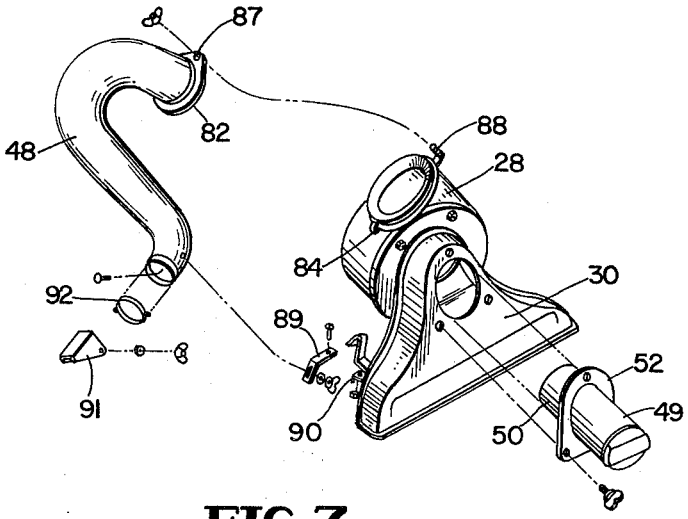
FIG. 7

SYSTEM FOR HANDLING DEBRIS

BACKGROUND

In recent times due to the ever pressing problem of pollution, the ecology movement has been increasing in importance and has now become an integral part of our everyday lives. With this new emphasis on ecology, many machines have been developed and built to clean, compact, and dispose of debris (refuse, rubbish and waste). These machines fall into one of the following forms:

1. LAWN VACUUMS: Machines which pick up debris through a flow of air (suction);
2. BLOWERS: Machines which move particles of debris by a directed stream or blast of air;
3. BAGGER: Vacuum type machine which deposits debris in a bag or container. It may take the form of a force load into disposable bags, etc.
4. COMPACTORS: Machines which reduce cubic capacity requirements, and force load into a container.
5. MULCHER: Machines which reduce the size of debris particle size by cutting, breaking, tearing, shearing or shredding.

The details of the system and the device will become apparent from the following and the drawings, wherein:

FIG. 5 is a view, partly in section, showing the side of the impeller and its blade, and its spaced relation to the housing, and the relation of the adapter pipe and the vacuum nozzle;

FIG. 6 is an exploded perspective view of the flexible extension hose; and

FIG. 7 is an exploded perspective view of the blower goose-neck tube and its air intake cowl.

Figure 1:
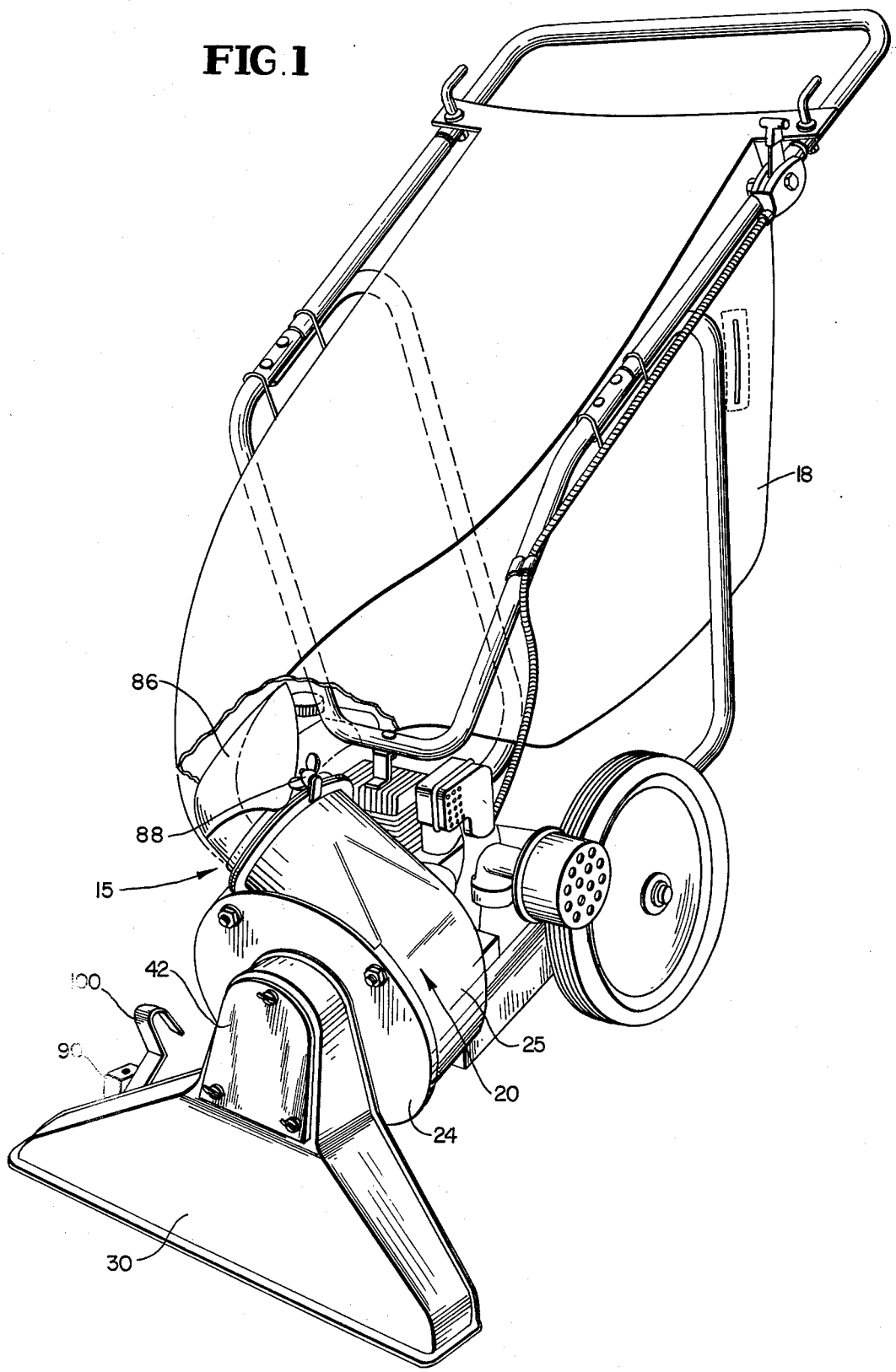
FIG. 1 is a perspective view of the basic machine.

The basic machine of FIG. 1 includes device 15, wheeled frame 16 with handle 17, internal combustion power unit 18 and bag 19.

Figures 2, 3, 4:
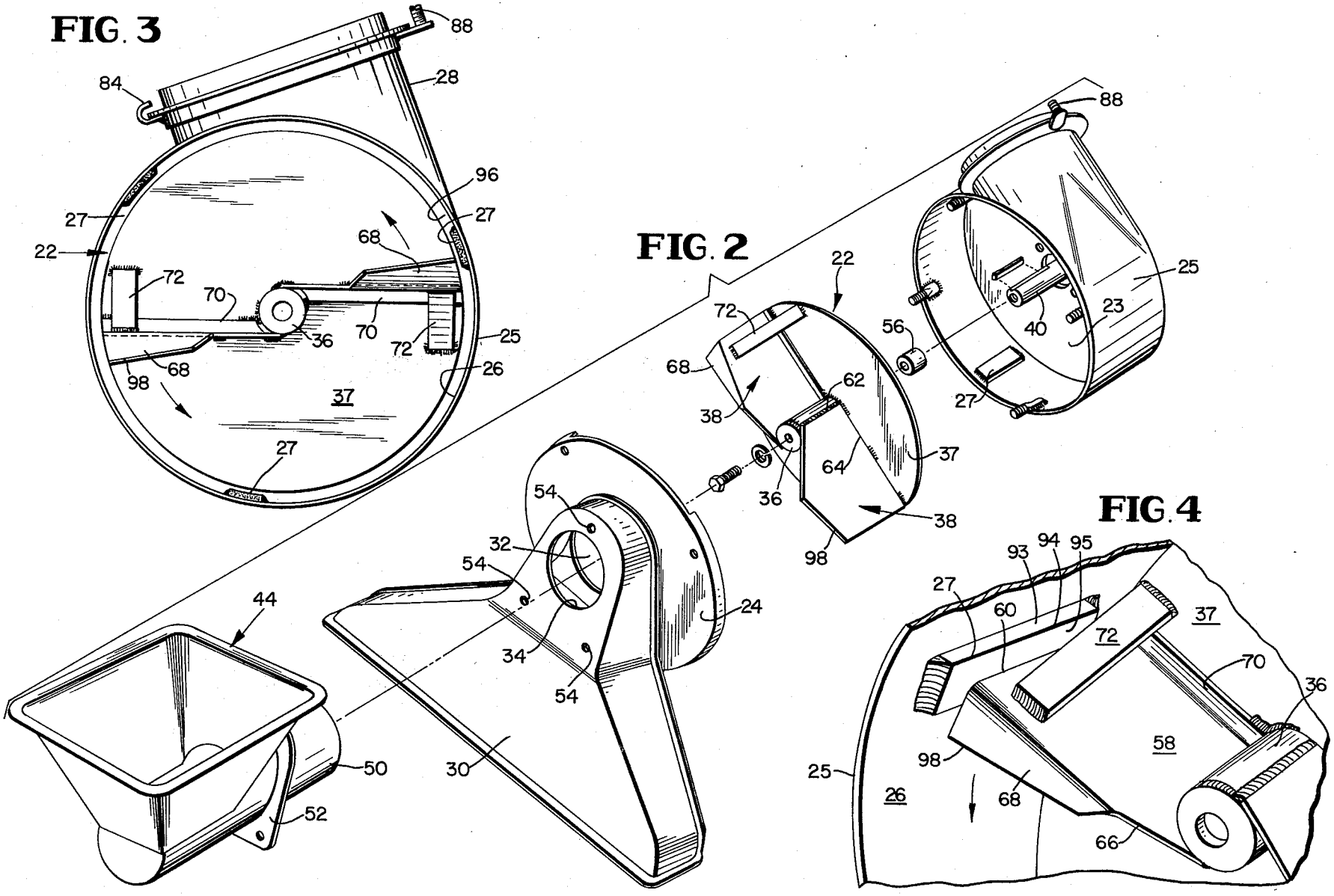
FIG. 2 is an exploded perspective view of the device and hopper.
FIG. 3 is a front end view of the impeller in the housing.
FIG. 4 is a perspective view of a portion of the impeller and housing.

Device 15 includes a housing 20 (FIGS. 2–5) and impeller 22. The housing 20 is formed by rear wall 23, front wall 24, and side wall 25 which has a curved inner surface 26 with shredding bars 27 mounted thereon and discharge chute 28 which extends substantially tangentially outwardly from the inner surface 26, the vacuum nozzle 30 being attached to the front wall 24 and extending forwardly and downwardly therefrom past the front wall inlet hole 32. FIG. 2 shows the nozzle front inlet hole 34 in axial horizontal alignment with the front wall inlet hole 32. Rotatably mounted within the housing 20 is impeller 22 which has a hub 36, a rear support 37 and blades 38, 38 extending substantially radially outwardly from the hub 36. The hub is adapted for connection to a rotatable stub shaft 40 extending forwardly through the rear wall 23.

The system for handling debris, such as leaves, twigs, refuse and the like comprises the device 15 and (1) cover face plate 42, (2) hopper 44, (3) flexible extension hose 46, (4) blower goose-neck tube 48 and its air intake cowl 49, and (5) receptacle 18. Certain units of the system are mounted selectively on the device 15 to shred debris, these being hopper 44, hose 46 and as discussed, vacuum nozzle 30. A powerful blow or blast of air for moving debris is selectively provided by mounting the air intake cowl 49 on the nozzle 30 and its goose-neck tube 48 on the discharge chute 28. A pipe 50 shuts off suction through the vacuum nozzle 30 and provides a direct suction path to the impeller housing 20 for the units.

FIG. 5 shows the cantilevered type mounting of the units by the pipe 50 and the flange 52 which surrounds the nozzle front inlet hole 34 and enables use of the same threaded mounting holes 54 and thumb screws 55 as used for the face plate 42 when the vacuum nozzle 30 is used (FIG. 1).

Preferably, each unit 44 and 49 has its own pipe 50 and flange 52. Inner surface 26 of housing 20 is cylindrical or circular in cross section. Suction inlet holes conform to the shape of pipe 50 to insure leakproof flow; in the embodiment shown they are formed to receive the circular pipe 50. The slanted inlet hole 34 would be somewhat eliptical; the vertical inlet hole 32 is circular and it is at this location particularly that a reasonable tight fit of pipe 50 reduces suction leakage. Impeller 22 is vertically disposed with its hub 36 adapted to receive and be keyed to the engine stub shaft 40. Spacer 56 properly locates the impeller 22 in housing 20 in spaced relationship from the rear and front walls 23 and 24. Impeller rear support 37 is a flat circular disc 37 which provides a rotating back wall for containing and directing movement of debris in the annular shredding zone located forwardly thereof. Balance of the high speed impeller 22 is provided by a balanced positioning of substantially radial blades 38 and 38 mounted on a substantially diametrical line with respect to the hub axis. Each blade includes a polyganal flat plate 58 extending substantially radially from hub 36, its outer peripheral edge 60 extending longitudinally of the hub, its inner edge 62 and rear edge 64 being welded to hub 36 and disc 37, respectfully and its forward edge 66 having a somewhat triangular knife 68 at its outer portion flared forwardly and extending transversely of the hub axis in the direction of impeller rotation. Each blade also has a trailing inturned radial edge panel 70 welded in face-to-face relation to the rear disc 37 and hub 36. A trailing diagonal brace 72 is welded to the trailing face of blade plate 58 near the peripheral forward edge thereof and to the disc 37 (FIG. 4).

The shredding bars 27 are longitudinally connected to the curved inner surface 26 of the housing 20. Each bar 27 is in the form of a parallelopiped having a leading shredding corner which presents a radial face 93, a corner edge 94 and a peripheral face 95 to debris brought into contact therewith by the impeller 22. The three bars 27 are positioned at 120° angularly spaced locations with one of them being positioned before and adjacent the first encountered edge 96 of the opening of the tangential discharge chute 28, as seen in FIG. 3, the first encountered edge being identified with respect to the rotation of the impeller.

FIG. 5 shows the clearance space between pipe 50 and impeller 22 which is established by flange 52.

FIG. 6 shows the flexible extension hose 46 and its hose pipe 50. The hose has a clamp 76 for attaching it to an outer pipe 77 and a similar clamp 78 for attaching the outer end of the hose to terminal pipe 79 which has a handle 80 affixed thereto.

FIG. 7 shows the blower goose-neck tube 48 which extends downwardly and outwardly from the discharge chute 28, its inner end having a rim 82 which is received under hook clip 84 (FIG. 3) after removal of discharge chute deflector 86. Rim 82 has a hole 87 for receipt of stud 88 to secure tube 48 to chute 28. A bracket 89 extends forwardly from the tube 48 for fixed connection to vacuum nozzle clip 90. A deflector 91 is provided for control of air discharge direction, the clamp ring 92 being rotatable and the deflector 91 being pivotally mounted on ring 92. The intake cowl 49 and its cowl pipe 50 replace the cover plate 42.

The knife or flange 68 has a forward flare whereby its front leading edge 98 of the impeller blade is at an angle to affect the most efficient vacuum action and also to act as a leading or first cutting edge of all debris drawn into the impeller housing. The debris is then centrifugally thrown radially outwardly away from the center of the impeller and toward the curved wall of the housing where it is trapped by the shredding bars and held while the impeller blades strike it repeatedly until it is thrown out the discharge chute into the bag or other suitable container.

Better vacuuming action is due to the high velocity and volume of air flowing through the machine. This is the direct result of the special shapes, sizes and contours of the nozzle, impeller, impeller housing, and discharge chute together with the concentric design of the impeller and impeller housing.

The shredding action is accomplished by the above design in combination with the high rotational speed of the impeller. Breaking and cutting of debris is caused by one or a combination of three different actions: (1) centrifugal force breakage at peripheral impeller blade edges; (2) perimeter breakage at the front leading edge of the blades, the inside edge on in-sweep and the outside edge on pocketed material; and (3) cutting and breaking between ends of blades and shredding bars.

The high blowing capability of the goose-neck tube is in part due to the venturi design thereof.

Casters are provided beneath nozzle 30 and are adjustable through spring lever 100 to raise and lower the nozzle.

Preferably, only one blade passes a shredding bar at any instant of time; this effectively utilizes the power available.

In general the accessory-type intake devices are the cover plate 42, hopper 44, flexible extension hose 46, and air intake cowl 49. The accessory-type exhaust devices are the receptacle 18 and the blower gooseneck 48.

We claim:

1. A system for handling debris, such as leaves, twigs, refuse and the like, convertible for use as a blower or as a vacuum, comprising:

a wheeled frame;

a device mounted on said frame including an impeller housing having a vertical rear wall, a vertical front wall and a side wall therebetween having a cylindrical inner surface and a top discharge chute extending tangentially outwardly from said surface, an impeller having a circular disc vertical rear support and a hub extending axially forward from said support and two substantially radial blades extending longitudinally of and substantially diametrically outwardly from the hub, said hub being adapted for coupling to a rotatable stub shaft extending through said rear wall, said front wall being spaced forwardly of said impeller and having an inlet hole larger than and axially aligned with said hub, a vacuum nozzle connected to and extending forwardly and downwardly from said front wall past said front wall and said frontwall inlet hole and having a front inlet hole in axial alignment with said front wall inlet hole;

an intake device optionally and removably mounted on said vacuum nozzle over said front inlet hole to allow for flow through said front wall inlet hole;

an exhaust device optionally and removably mounted on said discharge chute to allow exhaust flow therethrough;

three shredding bars longitudinally connected to the housing inner surface, each having a leading shredding elongated corner presenting a radial face, an edge and a peripheral face for debris shredding, one of the bars being positioned at the tangential connection of the chute to the inner surface and the other two bars being positioned at 120° locations therefrom so that only one blade at a time passes a shredding bar;

said blades each having an outer longitudinal peripheral edge and a forwardly flaring radial flange extending in the direction of rotation for coacting with said inner surface and shredding bars to produce an air and debris flow through the front wall inlet hole and the housing and the discharge chute and to shred the debris while in the housing.

2. A system as defined in claim 1 and wherein said intake device is a cover face plate and said exhaust device is a receptacle attached to said discharge chute.

3. A system as defined in claim 1 and wherein said intake device is a hopper having a hopper pipe positioned through the aligned inlet holes of the nozzle and the front wall which provides a suction path to the impeller housing and shuts off the suction path through the nozzle.

4. A system as defined in claim 1 and wherein said intake device is a flexible extension hose having a hose pipe positioned through the aligned inlet holes of the nozzle and the front wall which provides a suction path to the impeller housing and shuts off the suction path through the nozzle.

5. A system as defined in claim 1 and wherein said intake device is an air intake cowl having a cowl pipe positioned through the aligned inlet holes of the nozzle and the front wall which provides a suction path to the impeller housing and shuts off the suction path through the nozzle, and said exhaust device is a blower gooseneck attached to said discharge chute.

* * * * *